US011745307B2

(12) United States Patent
Chen et al.

(10) Patent No.: US 11,745,307 B2
(45) Date of Patent: Sep. 5, 2023

(54) AUTOMATIC GRINDING MACHINE WITH POSITIONING EFFECT

(71) Applicant: GLTTEK CO., LTD, Hsinchu (TW)

(72) Inventors: Chiung Nan Chen, Hsinchu (TW); Hsun Hao Chan, Hsinchu (TW)

(73) Assignee: GLTTEK CO., LTD, Hsinchu (TW)

( * ) Notice: Subject to any disclaimer, the term of this patent is extended or adjusted under 35 U.S.C. 154(b) by 444 days.

(21) Appl. No.: 17/173,890

(22) Filed: Feb. 11, 2021

(65) Prior Publication Data

US 2022/0250204 A1 Aug. 11, 2022

(51) Int. Cl.

| | |
|---|---|
| ***B24B 49/12*** | (2006.01) |
| ***B24B 41/06*** | (2012.01) |
| ***B24B 51/00*** | (2006.01) |
| ***B24B 49/00*** | (2012.01) |

(52) U.S. Cl.

CPC ..... *B24B 49/12* (2013.01); *B24B 41/06* (2013.01); *B24B 49/003* (2013.01); *B24B 51/00* (2013.01)

(58) Field of Classification Search

CPC ..... B24B 49/12; B24B 41/06; B24B 51/00; B24B 37/042; B24B 19/16; B24B 13/00; G01R 3/00

See application file for complete search history.

(56) References Cited

U.S. PATENT DOCUMENTS

| | | | | |
|---|---|---|---|---|
| 6,024,629 | A * | 2/2000 | Takekoshi | B23Q 3/15526 451/28 |
| 7,306,849 | B2 * | 12/2007 | Buckholtz | G01R 3/00 451/527 |
| 7,987,583 | B2 * | 8/2011 | Tokutomi | G11B 5/3166 451/36 |
| 9,983,145 | B1 * | 5/2018 | Chen | G01N 21/95684 |

* cited by examiner

*Primary Examiner* — Joel D Crandall

(74) *Attorney, Agent, or Firm* — Muncy, Geissler, Olds & Lowe, P.C.

(57) ABSTRACT

An automatic grinding machine with positioning effect has a body, at least two positioning sets, and a processing set. The body has a base, a grinding mount, a drive device, and a fixture. The base has a chamber. The at least two positioning sets are connected to the body and each positioning set has a displacement device and an optical module. The displacement device is mounted in the chamber. The optical module is disposed on the displacement device and is moved relative to the grinding mount by the drive device to position locations of the grinding mount and a probe card. The processing set is electrically connected to the drive device and the fixture of the body and the displacement device and the optical module of each positioning set, and has a computer control interface.

20 Claims, 8 Drawing Sheets

AUTOMATIC GRINDING MACHINE WITH POSITIONING EFFECT

BACKGROUND OF THE INVENTION

1. Field of the Invention

The present invention relates to an automatic grinding machine, and more particularly to an automatic grinding machine with positioning effect, which can grind automatically, can improve grinding efficiency, and can save costs.

2. Description of Related Art

A conventional grinding machine for grinding probe cards may use a lens to confirm whether a carrier of the conventional grinding machine is abutted against a probe card in a single direction, and may use the longest and shortest probes of the probe card as a reference point for positioning the probe card. However, in a grinding process of the conventional grinding machine, using the single-direction positioning and the longest probe to find the reference point can only provide a rough positioning effect, and the conventional grinding machine still needs to be adjusted and positioned by an experienced personnel, which cannot effectively shorten the time required for grinding.

Therefore, the structure and operation method of the conventional grinding machine can only roughly find the reference point of the probe card, and cannot accurately position probes of the probe card to be ground. It achieves the required grinding standards by repeated tests and grinding, and this may relatively reduce the grinding efficiency of the conventional grinding machine. Furthermore, the operation and use of the conventional grinding machine need to rely on experienced personnel, thereby relatively restricting the practicability and applicability of the conventional grinding machine.

Additionally, because the height of the carrier of the conventional grinding machine needs to be adjusted and positioned manually, the conventional grinding machine is very time-consuming and cost-intensive in use. Further, the conventional grinding machine uses sandpapers to grind the probes of the probe card, and the sandpaper needs to be frequently replaced after grinding because of the structural strength and physical characteristics of the sandpaper, which increases the time required for the grinding process and the frequent replacement of the sandpaper also increases the required cost. In view of the above-mentioned problems, the conventional grinding machine really needs to be improved.

To overcome the shortcomings, the present invention tends to provide an automatic grinding machine with positioning effect to mitigate or obviate the aforementioned problem.

SUMMARY OF THE INVENTION

The main objective of the invention is to provide an automatic grinding machine with positioning effect, which can grind automatically, can improve grinding efficiency, and can save costs.

The automatic grinding machine in accordance with the present invention has a body, at least two positioning sets, and a processing set. The body has a base, a grinding mount, a drive device, and a fixture. The base has a chamber. The at least two positioning sets are connected to the body and each positioning set has a displacement device and an optical module. The displacement device is mounted in the chamber. The optical module is disposed on the displacement device and is moved relative to the grinding mount by the drive device to position locations of the grinding mount and a probe card. The processing set is electrically connected to the drive device and the fixture of the body and the displacement device and the optical module of each positioning set, and has a computer control interface.

Other objects, advantages and novel features of the invention will become more apparent from the following detailed description when taken in conjunction with the accompanying drawings.

DETAILED DESCRIPTION OF PREFERRED EMBODIMENT

Figure 1:
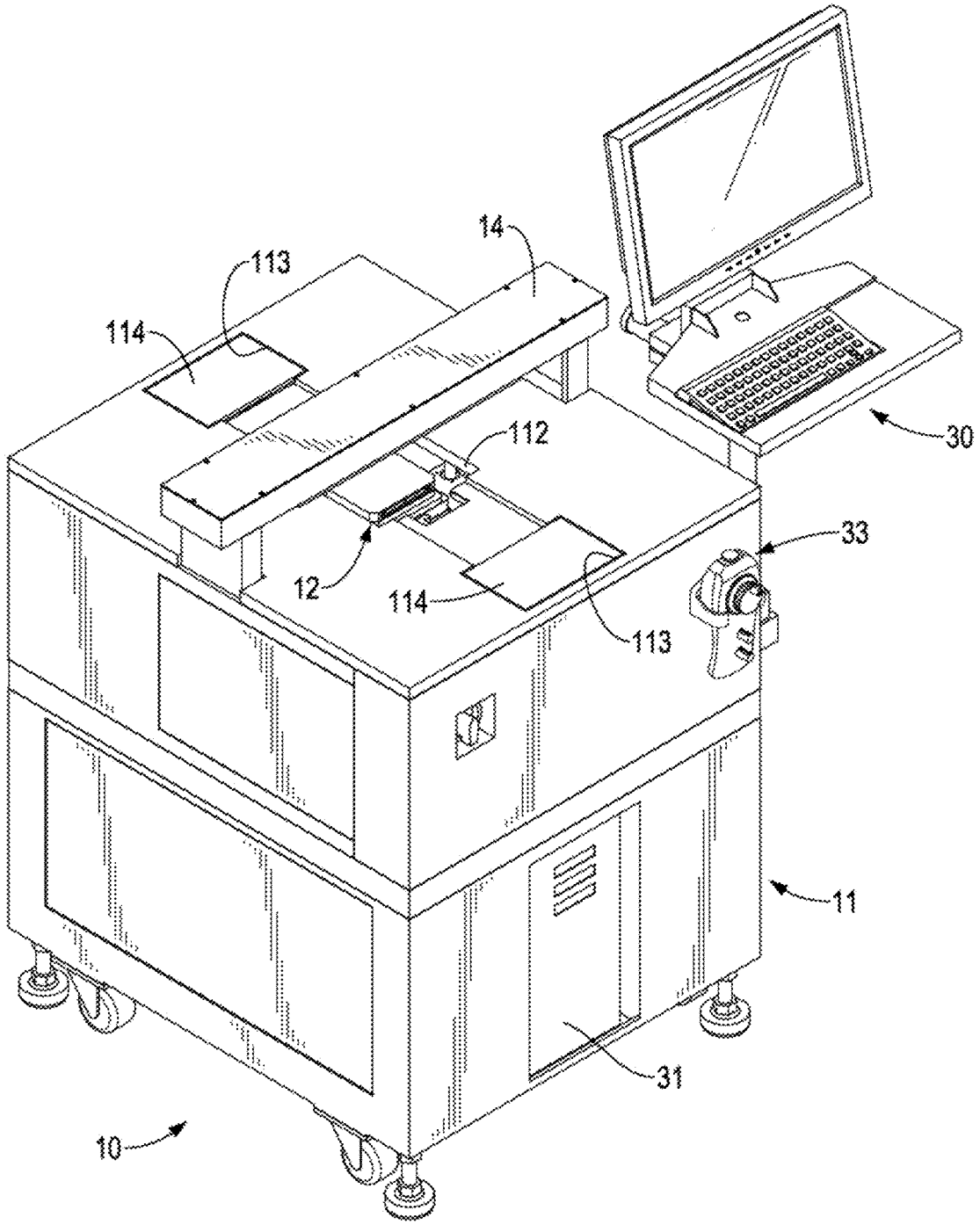
FIG. 1 is a perspective view of an automatic grinding machine with positioning effect in accordance with the present invention.
Figure 2:
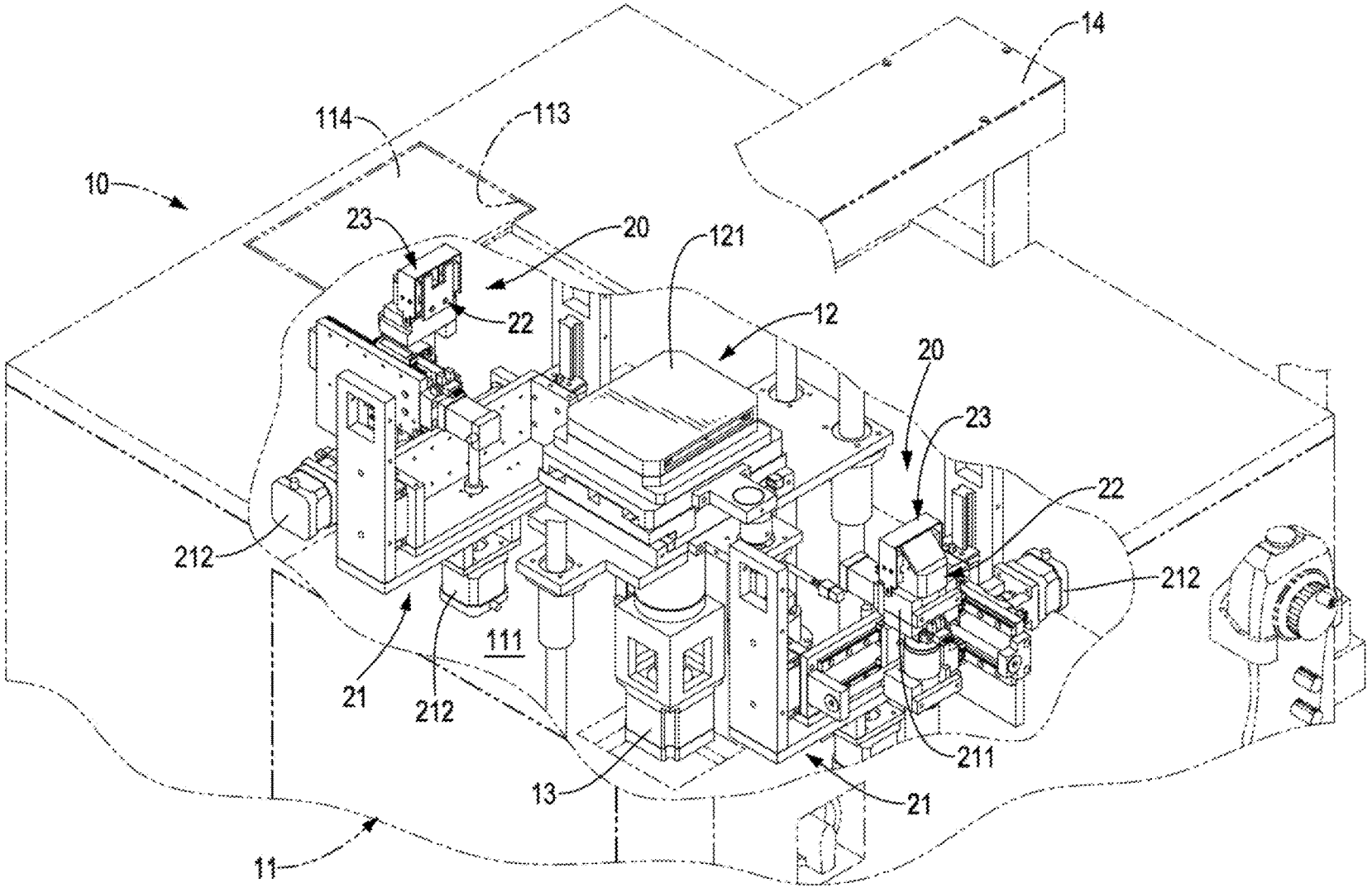
FIG. 2 is an enlarged perspective view of the automatic grinding machine in FIG. 1.

With reference to FIGS. 1 and 2, an automatic grinding machine with positioning effect in accordance with the present invention has a body 10, at least two positioning sets 20, and a processing set 30.

Figure 3:
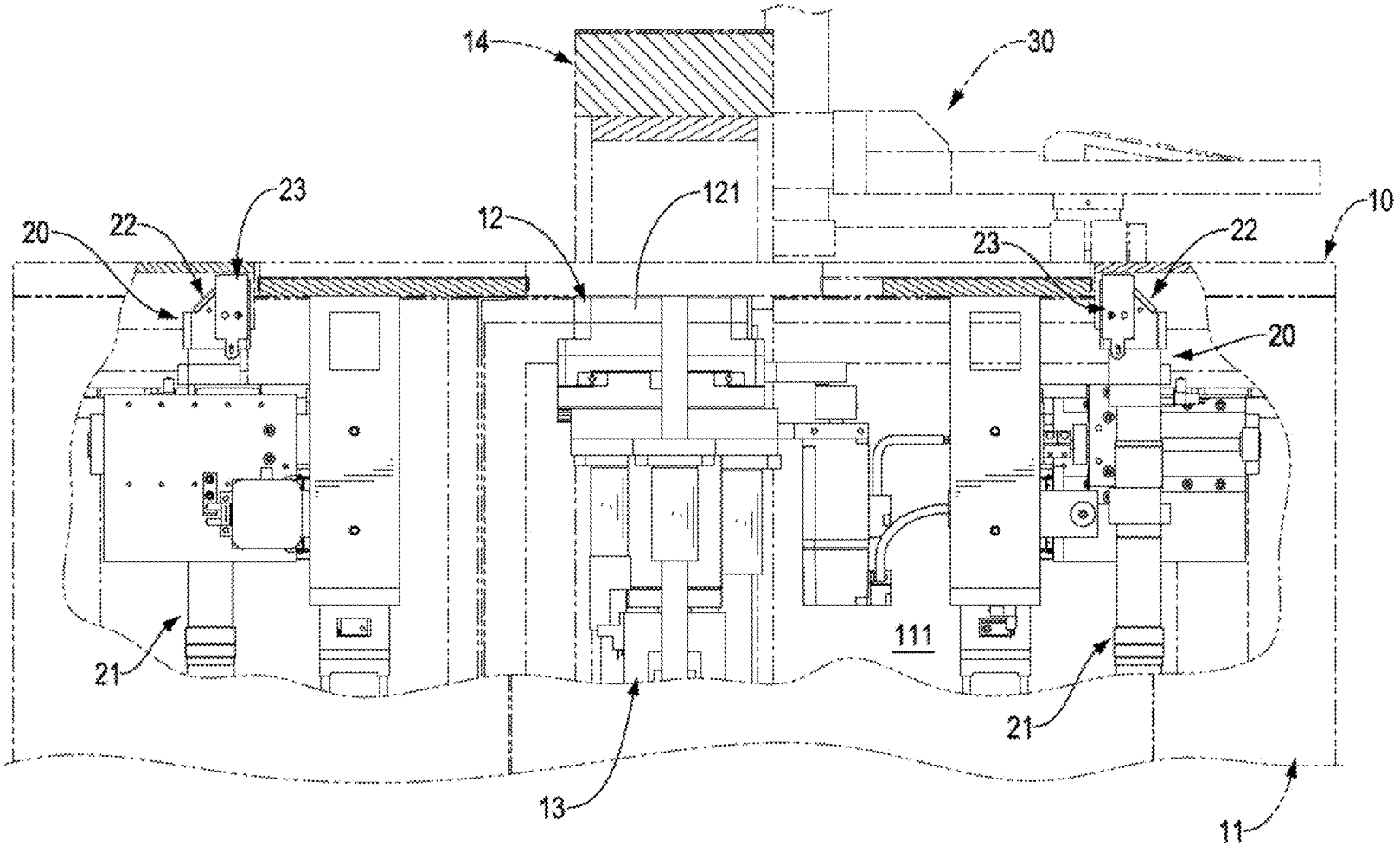
FIG. 3 is an enlarged side view in partial section of the automatic grinding machine in FIG. 1.

With reference to FIGS. 1 to 3, the body 10 has a base 11, a grinding mount 12, a drive device 13, and a fixture 14. The base 11 has a chamber 111, a processing opening 112, at least two mounting portions 113, and at least two covers 114. The chamber 111 is formed in the base 11. The processing opening 112 is formed through a top side of the base 11 and communicates with the chamber 111. The at least two mounting portions 113 are disposed on the top side of the base 11 beside the processing opening 112, and the at least two mounting portions 113 may align with each other or be disposed with an included angle between them. Preferably, the base 11 has multiple mounting portions 113 disposed on the top side of the base 11 around the processing opening 112. For example, there are three or four mounting portions 113 disposed on the top side of the base 11 around the processing opening 112. Each one of the at least two covers 114 is disposed on the top side of the base 11 and is mounted on one of the at least two mounting portions 113.

The grinding mount 12 is disposed on the base 11 at the processing opening 112 and has a grinding face 121. The grinding face 121 may be a grinding stone and may be made of diamond, zirconia or marble. The drive device 13 is mounted in the chamber 111 of the base 11 and is connected to the grinding mount 12 to drive the grinding mount 12 to move relative to the base 11. The fixture 14 is disposed on the base 11 above the grinding mount 12, is used to clamp a probe card for the grinding mount 12 to grind probes on the probe card.

Figure 4:
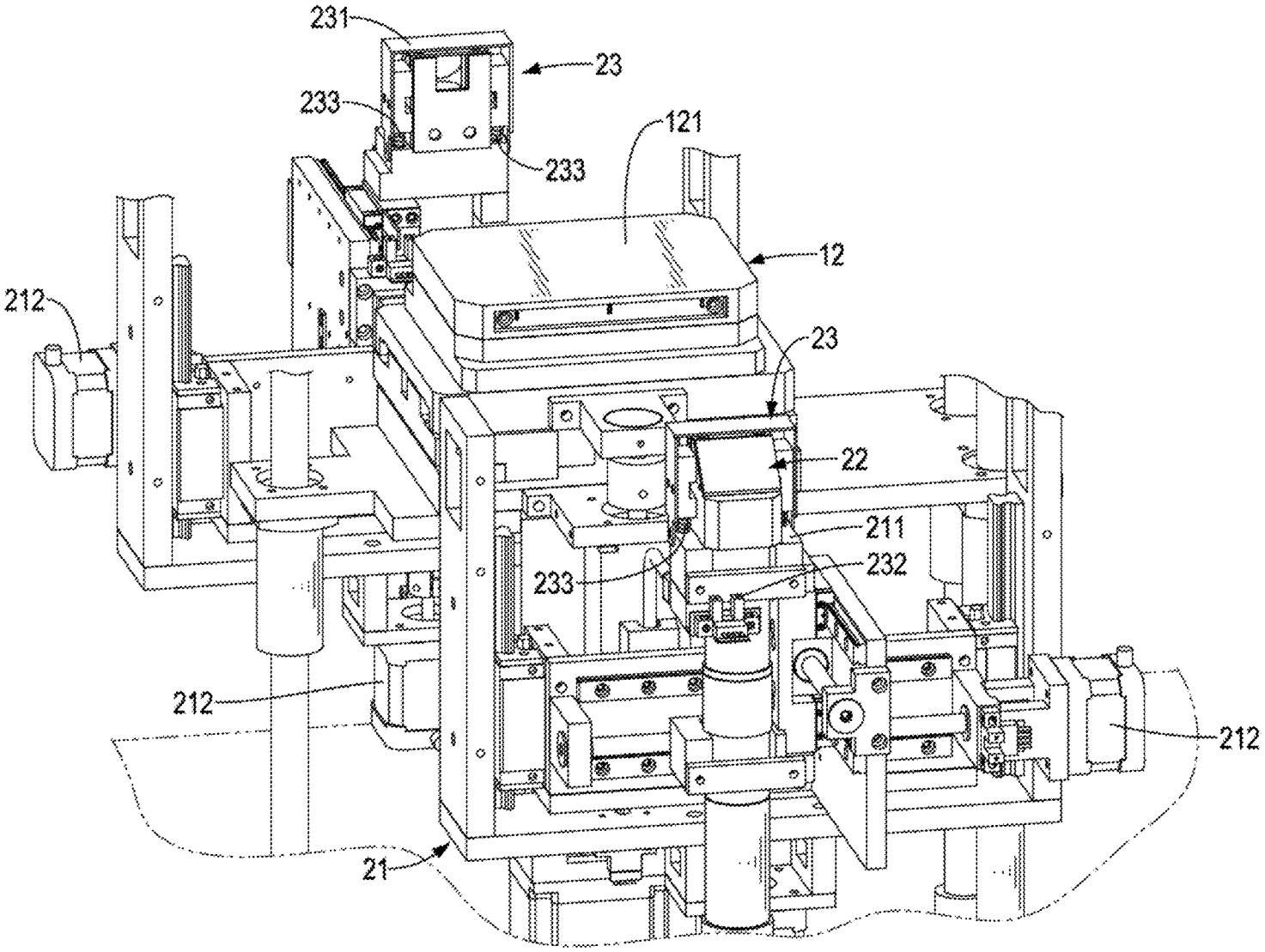
FIG. 4 is another enlarged perspective view of the automatic grinding machine in FIG. 1.
Figure 5:
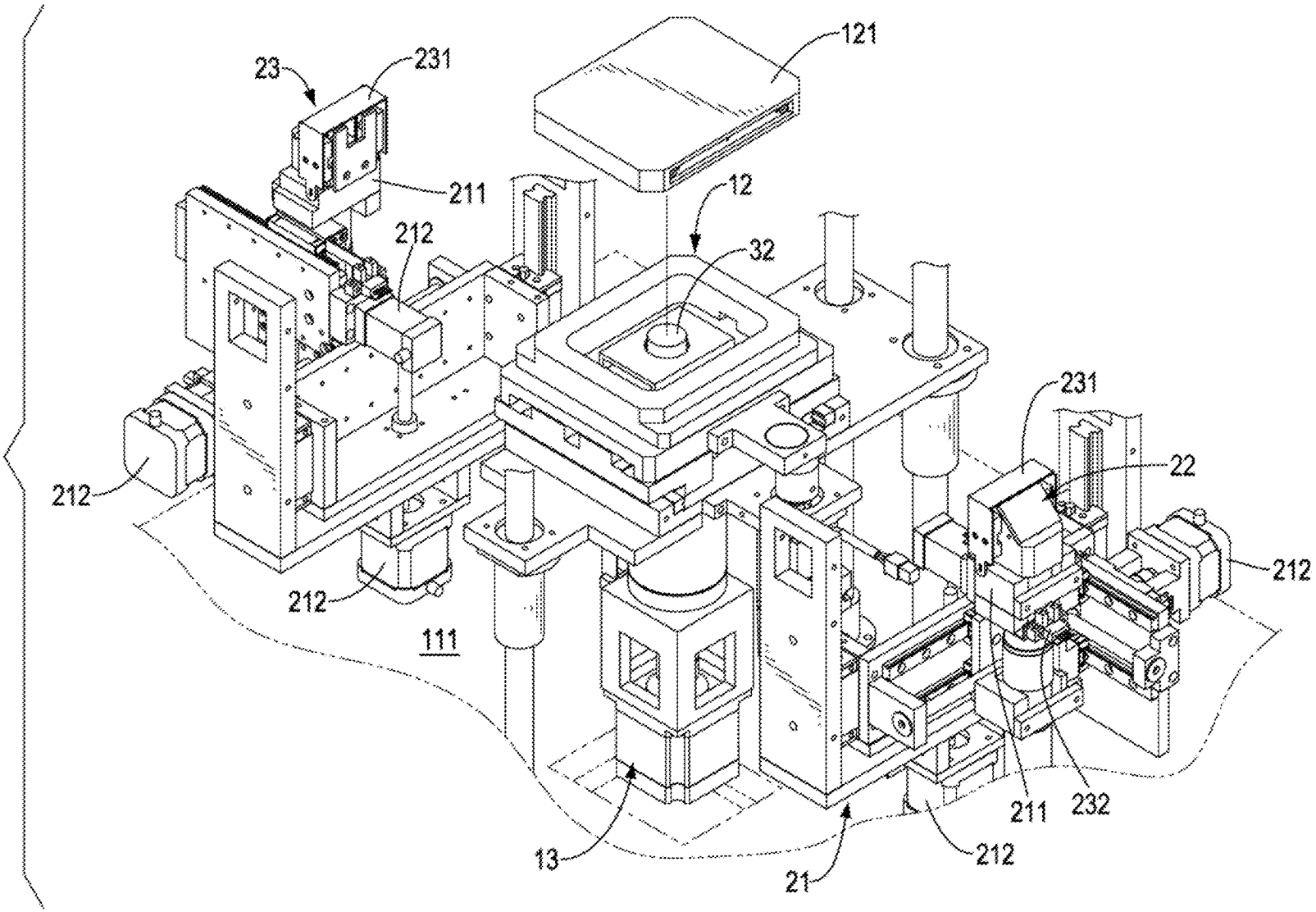
FIG. 5 is an enlarged and exploded perspective view of the automatic grinding machine in FIG. 1.

With reference to FIGS. 2, 4, and 5, the at least two positioning sets 20 are connected to the body 10, and each one of the at least two positioning sets 20 is located at one of the at least two mounting portions 113. Preferably, in the automatic grinding machine of the present invention, the number of the positioning set 20 is corresponding to the number of the mounting portion 113 of the base 11. Each one of the at least two positioning sets 20 has a displacement device 21, an optical module 22, and a protection device 23. The displacement device 21 is mounted in the chamber 111 of the base 11 and has a mounting seat 211 and multiple driving units 212. The mounting seat 211 is mounted in the chamber 111 of the base 11. The multiple driving units 212 are mounted in the chamber 111 of the base 11, and are connected to the mounting seat 211 to drive the mounting seat 211 to linearly move in multiple directions relative to the base 11. Each one of the multiple driving units 212 may be a slide-rail drive device, a cylinder-type drive device or a ball-type drive device, as long as it can provide a multi-directional drive device, and its configuration is not limited in the present invention.

The optical module 22 of each positioning set 20 is disposed on the mounting seat 211 of the displacement device 21 of the positioning set 20, is located below the cover 114 at a respective one of the mounting portions 113, and is moved relative to the grinding mount 12 via the actuation of the corresponding displacement device 21 to capture images of the grinding mount 12, the grinding face 121, and the probe card. Furthermore, the optical module 22 of each positioning set 20 captures images of the probes of the probe card at a side of the probe card adjacent to the optical module 22 (the longest/shortest probe). Preferably, the automatic grinding machine of the present invention has two optical modules 22, respectively a front optical module and a rear optical module, to respectively capture images of front row probes at a front side of the probe card and rear row probes at a rear side of the probe card (probe length detection).

With reference to FIGS. 4 and 5, the protection device 23 of each positioning set 20 is disposed on the optical module 22 of the positioning set 20, and has a protecting cap 231, a sensor 232, and multiple buffering elements 233. The protecting cap 231 is mounted on the mounting seat 211 of the displacement device 21 and is movably mounted around the optical module 22. The sensor 232 is disposed on the mounting seat 211 of the displacement device 21, and is selectively triggered by a movement of the protecting cap 231 relative to the optical module 22 to stop the actuation of the displacement device 21, and this can prevent the optical module 22 knocking against the probe card or other components of the base 11 when the optical module 22 is moved relative to the base 11 and the probe card. The multiple buffering elements 233 are disposed between the protecting cap 231 and the mounting seat 211 to provide a buffering effect to the protecting cap 231 when the protecting cap 231 is knocked against the probe card or the components of the base 11, thereby avoiding damage to the corresponding optical module 22.

Figure 6:
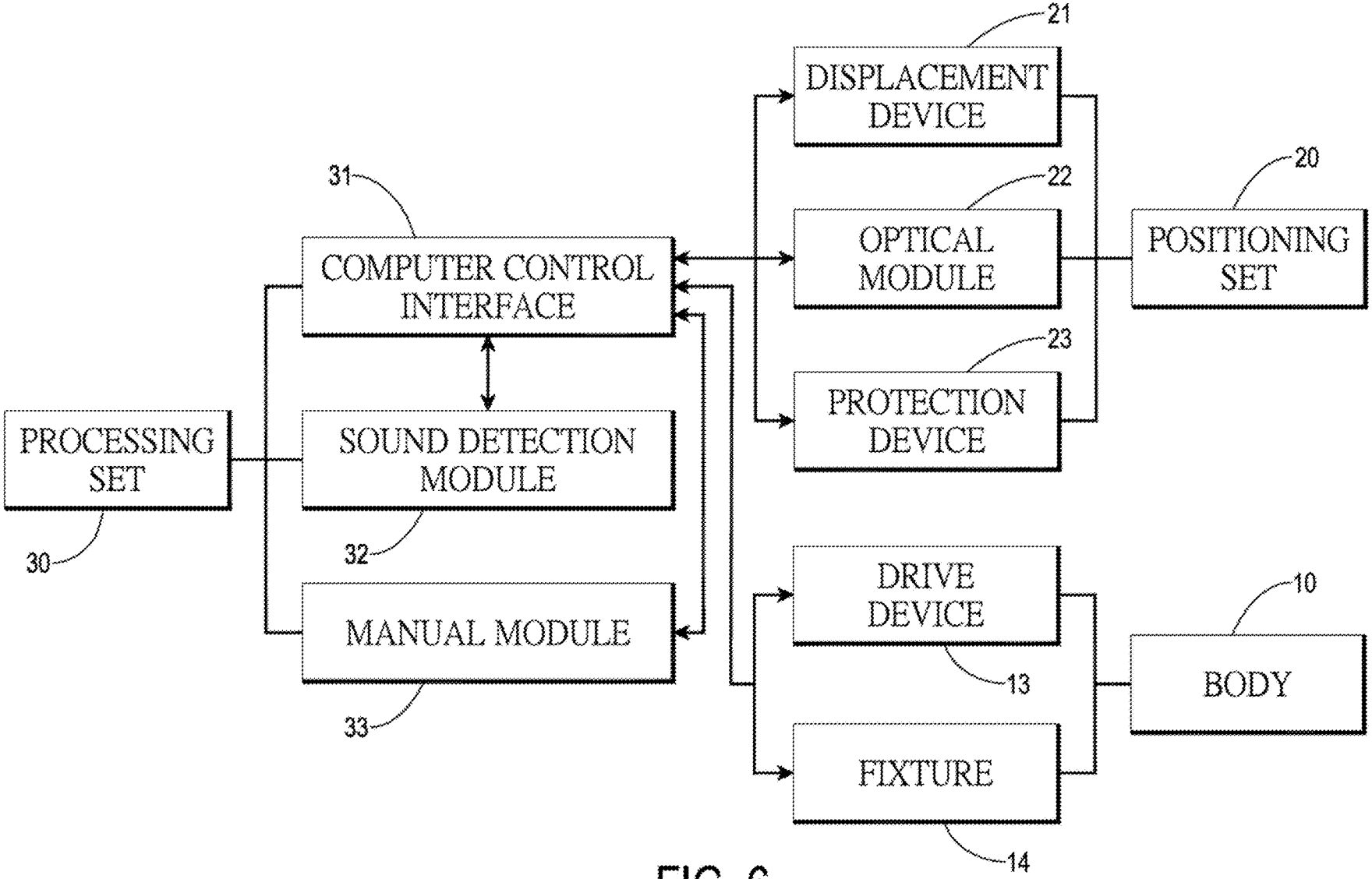
FIG. 6 is a circuit block diagram of the automatic grinding machine in FIG. 1.
Figure 7:
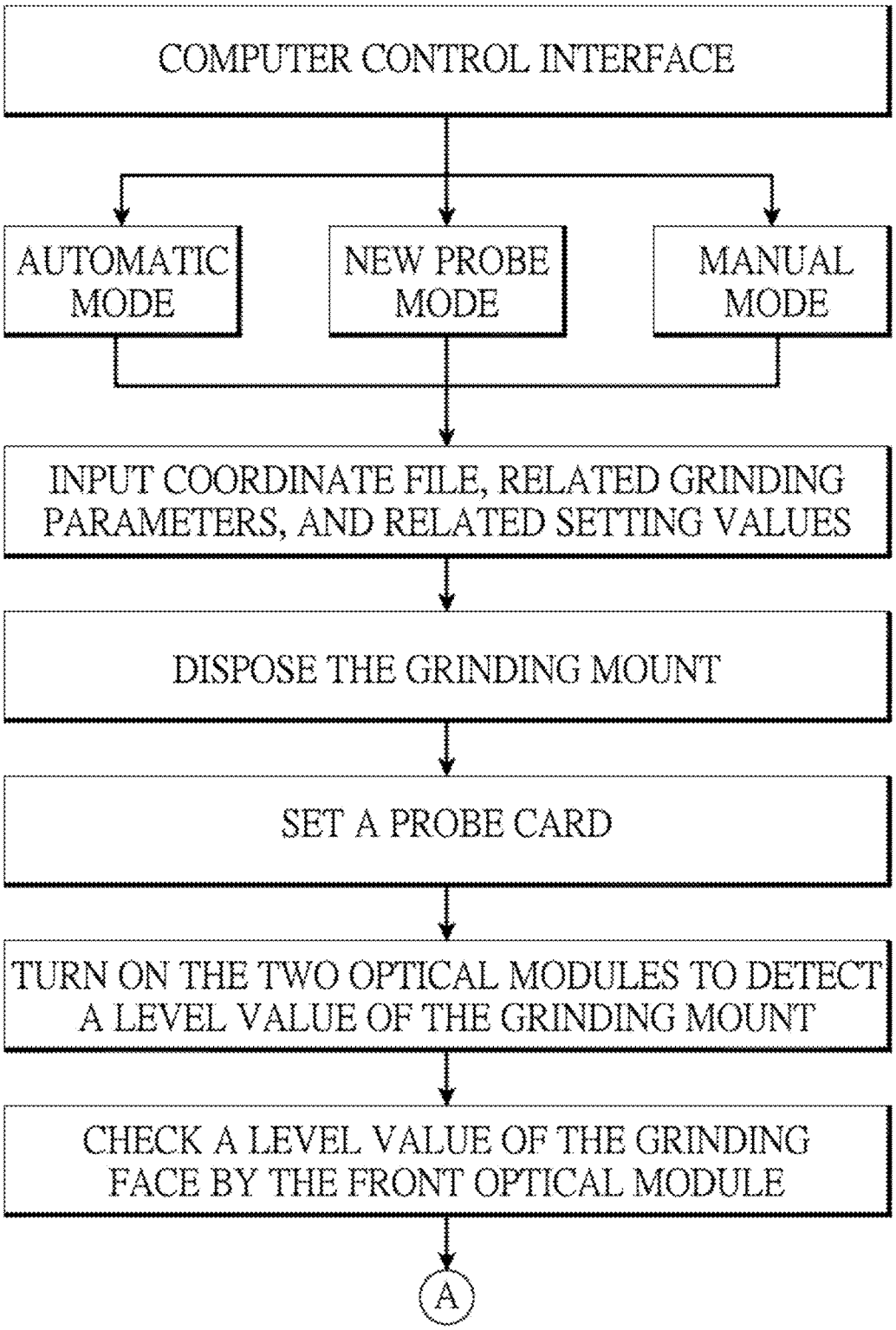
FIGS. 7 and 8 are operational block diagrams of the automatic grinding machine in FIG. 1, and "A" is a connection symbol.
Figure 8:
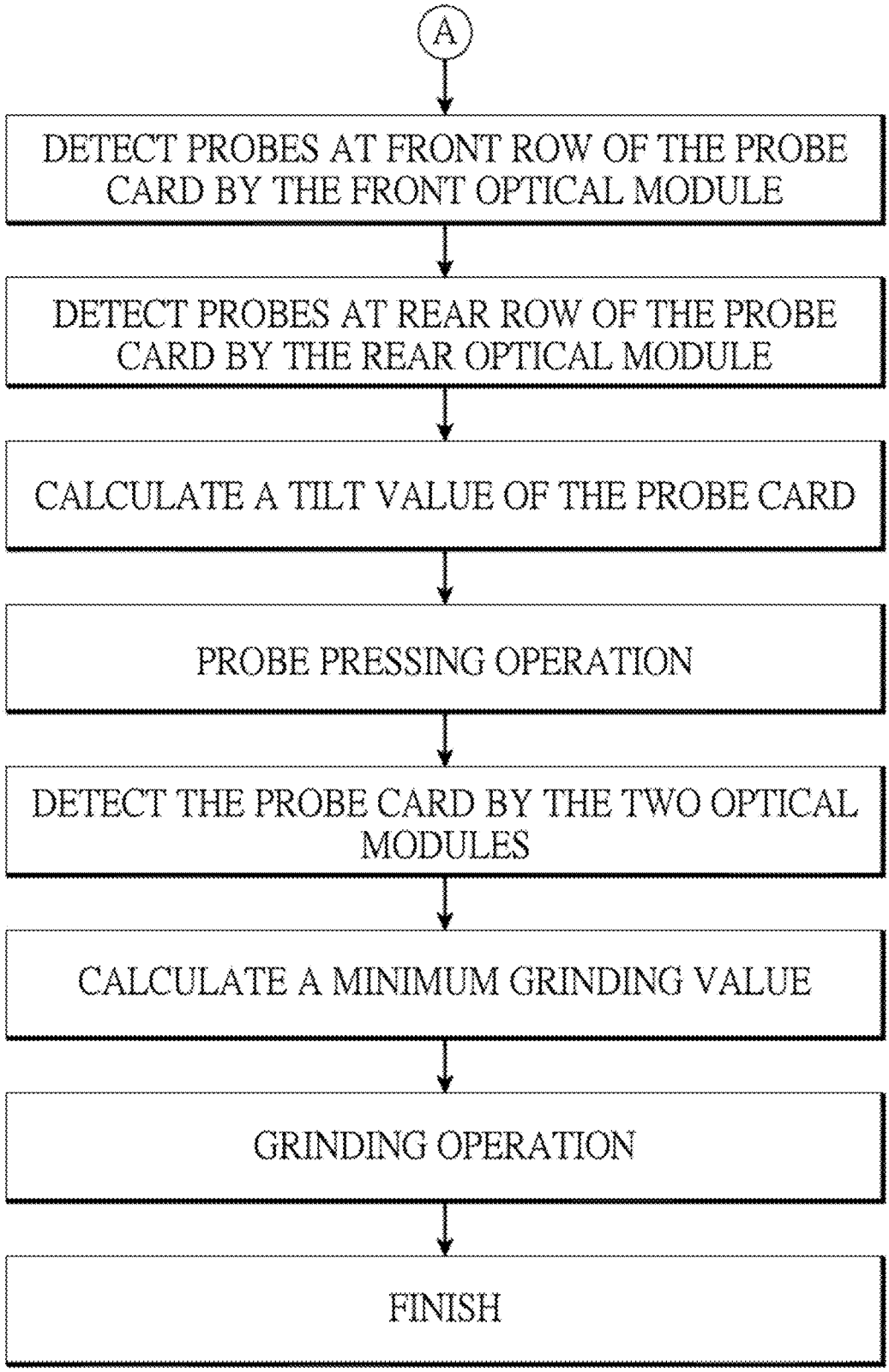

With reference to FIGS. 1 and 6, the processing set 30 is connected to the body 10 and the at least two positioning sets 20 and has a computer control interface 31, a sound detection module 32, and a manual module 33. The computer control interface 31 is electrically connected to the drive device 13 and the fixture 14 of the body 10, the drive device 13 is controlled by the computer control interface 31 to drive the grinding mount 12 to move, and the fixture 14 is controlled by the computer control interface 31 to clamp the probe card moving relative to the grinding mount 12. Furthermore, the computer control interface 31 is electrically connected to the displacement device 21, the optical module 22, and the protection device 23 of each positioning set 20, the displacement devices 21 are controlled by the computer control interface 31 to move the optical modules 22 relative to the base 11, and the locations of the grinding mount 12, the grinding face 121, and the probe card can be positioned via the optical modules 22 of the at least two positioning sets 20. In addition, the actuation of each displacement device 21 is controlled by the computer control interface 31 via the signal detection and transmission of each protection device 23 to the computer control interface 31, and this may prevent each optical module 22 from being damaged by knocking against the probe card or the components of the base 11.

With reference to FIG. 5, the sound detection module 32 is mounted in the grinding mount 12, is electrically connected to the computer control interface 31 and is used to collect sound frequency generated during a grinding process to accurately identify a grinding position of the grinding mount 12. The manual module 33 is disposed on the base 11 of the body 10, and is electrically connected to the computer control interface 31. The actuations of the drive device 13 and the fixture 14 of the body 10 and the displacement device 21 and the optical module 22 of each positioning set 20 can be controlled by the manual module 33 via the computer control interface 31, and the structure and operation mode of the manual module 33 are conventional and are not described in detail.

With reference to FIGS. 1, 6, 7, and 8, when the automatic grinding machine with positioning effect of the present invention is in use, three modes including an automatic mode, a new probe mode, and an manual mode (via the manual module 33) are set in the computer control interface 31, and an operator can select one of the three modes to control the grinding operation of the automatic grinding machine. After selecting one of the three modes, input a coordinate file, related grinding parameters, and related setting values corresponding to the probe card, dispose the grinding mount 12 on the drive device 13 via the processing opening 112, set the probe card on the fixture 14 and move the probe card to the grinding mount 12 by the fixture 14. Then, turn on the at least two optical modules 22 and detect a level value of the grinding mount 12 (a level value is less than a setting level value). After detecting the level value of the grinding mount 12 and move the front optical module 22 to check whether the grinding face 121 is set and a level value of the grinding face 121 (set and the level value is less than a setting level value). After confirming the level condition of the polishing face 121, move the grinding mount 12 to the probe card by the drive device 13. Turn on the front optical module 22 to detect probes at a front row of the probe card, and then turn on the rear optical module 22 to detect probes at a rear row of the probe card. Wherein the automatic grinding machine has multiple optical modules 22, probes at each side of the probe card are respectively detected by the multiple optical modules 22.

After the above-mentioned measurement, a tilt value of the probe card is calculated by the computer control interface 31. If the tilt value is less than a setting tilt value, the grinding mount 12 is driven to press against the probes of the probe card. After the pressing operation, detect the probe card via the at least two optical modules 22 to calculate a minimum grinding value (a recommended value) by the computer control interface 31, and the grinding mount 12 is driven to grind the probe card. With reference to FIG. 5, a sound frequency generated during the grinding process can be collected by the sound detection module 32 to accurately identify the grinding position of the grinding mount 12. After grinding the probes of the probe card, lengths of the probes of the probe card are measured by the at least two optical modules 22, so as to record and save the relevant parameters and grinding results of the probe card in the computer control interface 31.

According to the above-mentioned features and structural relationships of the automatic grinding machine with positioning effect of the present invention, after disposing the probe card on the fixture 14, selecting the mode and inputting the coordinate file and grinding parameters, each displacement device 21 is actuated by the computer control interface 31 of the processing set 30. The optical modules 22 are moved by the displacement devices 21 to measure and calculate the positions, installations, and lengths of the probes for the grinding mount 12, the grinding face 121, and the probe card to be processed, and a minimum grinding value is calculated by the computer control interface 31. Then the probe card can be automatically ground by the automatic grinding machine of the present invention, and this is convenient in use.

In addition, the at least two optical modules 22 are used to provide at least two directional measurements, which can effectively improve the positioning and accuracy for grinding the probe card, and reduce the time and cost required for manual adjustment by experienced personnel. Furthermore, the sound frequency generated during the grinding process can be collected to accurately identify the grinding location of the grinding mount 12 by disposing the sound detection module 32 in the grinding mount 12 and this can shorten the time required for the grinding process and can effectively improve the grinding efficiency of the grinding mount 12.

Additionally, during the moving processes of the at least two optical modules 22, the protection device 23 is disposed on each optical module 22 to effectively prevent the corresponding optical module 22 from knocking against the probe card or other components of the base 11. Further, using a grinding stone as the grinding face 121 can reduce the frequency and cost of replacing sandpaper during the grinding process. Therefore, the present invention provides an automatic grinding machine with positioning effect, which can grind automatically, can improve grinding efficiency, and can save costs.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An automatic grinding machine with positioning effect comprising:

a body having a base having a chamber formed in the base; and a processing opening formed through a top side of the base and communicating with the chamber;

a grinding mount disposed on the base at the processing opening;

a drive device mounted in the chamber of the base and connected to the grinding mount to drive the grinding mount to move relative to the base; and a fixture disposed on the base above the grinding mount to clamp a probe card;

at least two positioning sets connected to the body, and each one of the at least two positioning sets having a displacement device mounted in the chamber of the base; and an optical module disposed on the displacement device and driven by the displacement device to move relative to the grinding mount to detect and position locations of the grinding mount and the probe card; and a processing set connected to the body and the at least two positioning sets and having a computer control interface electrically connected to the drive device and the fixture of the body and the displacement device and the optical module of each one of the at least two positioning sets.

2. The automatic grinding machine as claimed in claim 1, wherein the base has at least two mounting portions disposed on the top side of the base beside the processing opening; and at least two covers, and each one of the at least two covers disposed on the top side of the base and mounted on one of the at least two mounting portions; and each one of the at least two positioning sets is located at one of the at least two mounting portions of the base.

3. The automatic grinding machine as claimed in claim 2, wherein the displacement device of each one of the at least two positioning sets has a mounting seat mounted in the chamber of the base; and multiple driving units mounted in the chamber of the base and connected to the mounting seat to drive the mounting seat to linearly move in multiple directions relative to the base; and the optical module of each one of the at least two positioning sets is disposed on the mounting seat of the displacement device of the corresponding positioning set, and is located below the cover at a respective one of the mounting portions to capture images of the grinding mount and the probe card.

4. The automatic grinding machine as claimed in claim 3, wherein each one of the at least two positioning sets has a protection device disposed on the optical module of the positioning set, electrically connected to the computer control interface, and having a protecting cap mounted on the displacement device of the positioning set and movably mounted around the optical module of the positioning set;

a sensor disposed on the displacement device of the positioning set, selectively triggered by a movement of the protecting cap relative to the optical module of the positioning set to stop an actuation of the displacement device; and multiple buffering elements disposed between the protecting cap and the displacement device of the positioning set.

5. The automatic grinding machine as claimed in claim 1, wherein the automatic grinding machine has two optical modules, respectively a front optical module and a rear optical module, to respectively capture images of front row probes at a front side of the probe card and rear row probes at a rear side of the probe card.

6. The automatic grinding machine as claimed in claim 2, wherein the automatic grinding machine has two optical modules, respectively a front optical module and a rear optical module, to respectively capture images of front row probes at a front side of the probe card and rear row probes at a rear side of the probe card.

7. The automatic grinding machine as claimed in claim 3, wherein the automatic grinding machine has two optical modules, respectively a front optical module and a rear optical module, to respectively capture images of front row probes at a front side of the probe card and rear row probes at a rear side of the probe card.

8. The automatic grinding machine as claimed in claim 4, wherein the automatic grinding machine has two optical modules, respectively a front optical module and a rear optical module, to respectively capture images of front row probes at a front side of the probe card and rear row probes at a rear side of the probe card.

9. The automatic grinding machine as claimed in claim 5, wherein the processing set has a sound detection module mounted in the grinding mount, and electrically connected to the computer control interface to collect sound frequency generated during a grinding process to accurately identify a grinding position of the grinding mount.

10. The automatic grinding machine as claimed in claim 6, wherein the processing set has a sound detection module mounted in the grinding mount, and electrically connected to the computer control interface to collect sound frequency generated during a grinding process to accurately identify a grinding position of the grinding mount.

11. The automatic grinding machine as claimed in claim 7, wherein the processing set has a sound detection module mounted in the grinding mount, and electrically connected to the computer control interface to collect sound frequency generated during a grinding process to accurately identify a grinding position of the grinding mount.

12. The automatic grinding machine as claimed in claim 8, wherein the processing set has a sound detection module mounted in the grinding mount, and electrically connected to the computer control interface to collect sound frequency generated during a grinding process to accurately identify a grinding position of the grinding mount.

13. The automatic grinding machine as claimed in claim 9, wherein the processing set has a manual module electrically connected to the computer control interface to control the drive device and the fixture of the body and the displacement device and the optical module of each positioning set.

14. The automatic grinding machine as claimed in claim 10, wherein the processing set has a manual module electrically connected to the computer control interface to control the drive device and the fixture of the body and the displacement device and the optical module of each positioning set.

15. The automatic grinding machine as claimed in claim 11, wherein the processing set has a manual module electrically connected to the computer control interface to control the drive device and the fixture of the body and the displacement device and the optical module of each positioning set.

16. The automatic grinding machine as claimed in claim 12, wherein the processing set has a manual module electrically connected to the computer control interface to control the drive device and the fixture of the body and the displacement device and the optical module of each positioning set.

17. The automatic grinding machine as claimed in claim 1, wherein the processing set has a sound detection module mounted in the grinding mount, and electrically connected to the computer control interface to collect sound frequency generated during a grinding process to accurately identify a grinding position of the grinding mount.

18. The automatic grinding machine as claimed in claim 2, wherein the processing set has a sound detection module mounted in the grinding mount, and electrically connected to the computer control interface to collect sound frequency generated during a grinding process to accurately identify a grinding position of the grinding mount.

19. The automatic grinding machine as claimed in claim 1, wherein the processing set has a manual module electrically connected to the computer control interface to control the drive device and the fixture of the body and the displacement device and the optical module of each positioning set.

20. The automatic grinding machine as claimed in claim 1, wherein the grinding mount has a grinding face.

* * * * *